US011415914B2

(12) United States Patent
Saeki et al.

(10) Patent No.: US 11,415,914 B2
(45) Date of Patent: Aug. 16, 2022

(54) IMAGE RECORDING APPARATUS

(71) Applicant: CANON KABUSHIKI KAISHA, Tokyo (JP)

(72) Inventors: Tsuyoshi Saeki, Kanagawa (JP); Tetsuya Ishikawa, Kanagawa (JP); Yoshiyuki Kurita, Saitama (JP); Takashi Abe, Kanagawa (JP); Yumi Mukoyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/336,509

(22) Filed: Jun. 2, 2021

(65) Prior Publication Data

US 2021/0382420 A1 Dec. 9, 2021

(30) Foreign Application Priority Data

Jun. 9, 2020 (JP) ..... JP2020-100395

(51) Int. Cl.
*G03G 15/20* (2006.01)

(52) U.S. Cl.
CPC ..... *G03G 15/2028* (2013.01)

(58) Field of Classification Search
CPC ..... G03G 15/2028
See application file for complete search history.

(56) References Cited

FOREIGN PATENT DOCUMENTS

EP 2363293 B1 * 12/2015 ..... B41J 15/04
JP 05-104708 A 4/1993

* cited by examiner

*Primary Examiner* — Victor Verbitsky
(74) *Attorney, Agent, or Firm* — Venable LLP

(57) ABSTRACT

An image recording apparatus includes a first path for conveying a recording medium in order of a stacking portion on which the recording medium is stacked, a recording portion for recording an image on the recording medium, a heating portion for heating the image, and a discharge portion for discharging the recording medium; a second path branching off from the first path at a first branch part between the recording portion and the heating portion, and for discharging the recording medium to the discharge portion without passing through the heating portion; and a third path branching off from the first path at a second branch part between the recording portion and the first branch part, and for conveying the recording medium, the recording surface of which is inverted, toward a location between the stacking portion and the recording portion in the first path.

16 Claims, 11 Drawing Sheets

FIG. 5

| PATTERN | 1ST SURFACE RECORDING | 2ND SURFACE RECORDING | 1ST SURFACE DRYING | 2ND SURFACE DRYING | CONVEYING PATH |
|---|---|---|---|---|---|
| 1 | PERFORMED | NON-PERFORMED | PERFORMED | | MAIN(DRYING) |
| 2 | PERFORMED | NON-PERFORMED | NON-PERFORMED | — | MAIN→SUB |
| 3 | NON-PERFORMED | PERFORMED | | PERFORMED | MAIN→SUB→INVERSION→MAIN(DRYING) |
| 4 | NON-PERFORMED | PERFORMED | — | NON-PERFORMED | MAIN →SUB →INVERSION →MAIN →SUB |
| 5 | PERFORMED | PERFORMED | PERFORMED | PERFORMED | MAIN(DRYING)→INVERSION→MAIN(DRYING) |
| 6 | PERFORMED | PERFORMED | PERFORMED | NON-PERFORMED | MAIN(DRYING)→INVERSION→MAIN→SUB |
| 7 | PERFORMED | PERFORMED | NON-PERFORMED | PERFORMED | MAIN →SUB →INVERSION →MAIN(DRYING) |
| 8 | PERFORMED | PERFORMED | NON-PERFORMED | NON-PERFORMED | MAIN→SUB→INVERSION→MAIN →SUB |

19
14
13
20
23
S
17
56
18

13
14
17
18
19
20
21
22
S

IMAGE RECORDING APPARATUS

BACKGROUND OF THE INVENTION

Field of the Invention

The present invention relates to an image recording apparatus provided with a heat drying portion for promoting drying of a recording medium having an image recorded thereon.

Description of the Related Art

Conventionally, as an ink jet type recording apparatus for recording an image by discharging an ink to a recording medium, there have been recording apparatuses each having a heat drying portion on the downstream side of a recording portion in the conveying direction, for the purpose of suppressing curling of a recording medium and improving the aligning performance in a discharge tray. Of these, a recording apparatus has been known which is adapted to implement recording on various recording media by being made to select whether or not the heat drying portion is caused to act on a recording medium. For example, Japanese Patent Application Publication No. H05-104708 discloses a configuration enabling selection of whether heat drying on a recording medium is performed or not by having two paper discharge conveying paths and including a heat drying portion disposed at one paper discharge conveying path.

SUMMARY OF THE INVENTION

However, in the configuration disclosed in Japanese Patent Application Publication No. H05-104708, a conveying path for performing double-sided recording is not provided. As a result, for performing recording on the back surface (the second surface) of the recording medium, it is necessary, after completion of the recording operation on the front surface (first surface), to turn over the recording medium to be set at a paper feed portion again. This unfavorably results in low usability.

It is an object of the present invention to provide an image recording apparatus capable of selecting whether drying is performed or not for each surface of a recording medium in the configuration capable of carrying out double-sided recording.

In order to solve the foregoing problem, the image recording apparatus of the present invention includes:

a stacking portion on which a recording medium is stacked;

a recording portion for recording an image on the recording medium;

a heating portion for heating the recording medium recorded by the recording portion;

a discharge portion for discharging the recording medium recorded by the recording portion;

a first path for conveying the recording medium in order of the stacking portion, the recording portion, the heating portion, and the discharge portion;

a second path branching off from the first path at a first branch part between the recording portion and the heating portion, and for discharging the recording medium to the discharge portion without passing through the heating portion; and a third path branching off from the first path at a second branch part between the recording portion and the first branch part, and for conveying the recording medium, the recording surface of which is inverted, toward between the stacking portion and the recording portion in the first path.

The image recording apparatus of the present invention configured as described above has a reversal conveying path in addition to a main conveying path having the heat drying portion and a sub conveying path not having the heat drying portion. As a result, it is easy to carry out double-sided recording, and it is possible to select whether heat drying for each surface of the recording medium is performed or not.

Further features of the present invention will become apparent from the following description of exemplary embodiments with reference to the attached drawings.

BRIEF DESCRIPTION OF THE DRAWINGS

FIG. 5 is a view showing the difference in conveying path according to the combination of the recording surface and drying or non-drying;

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments.

Embodiment 1

Figure 1:
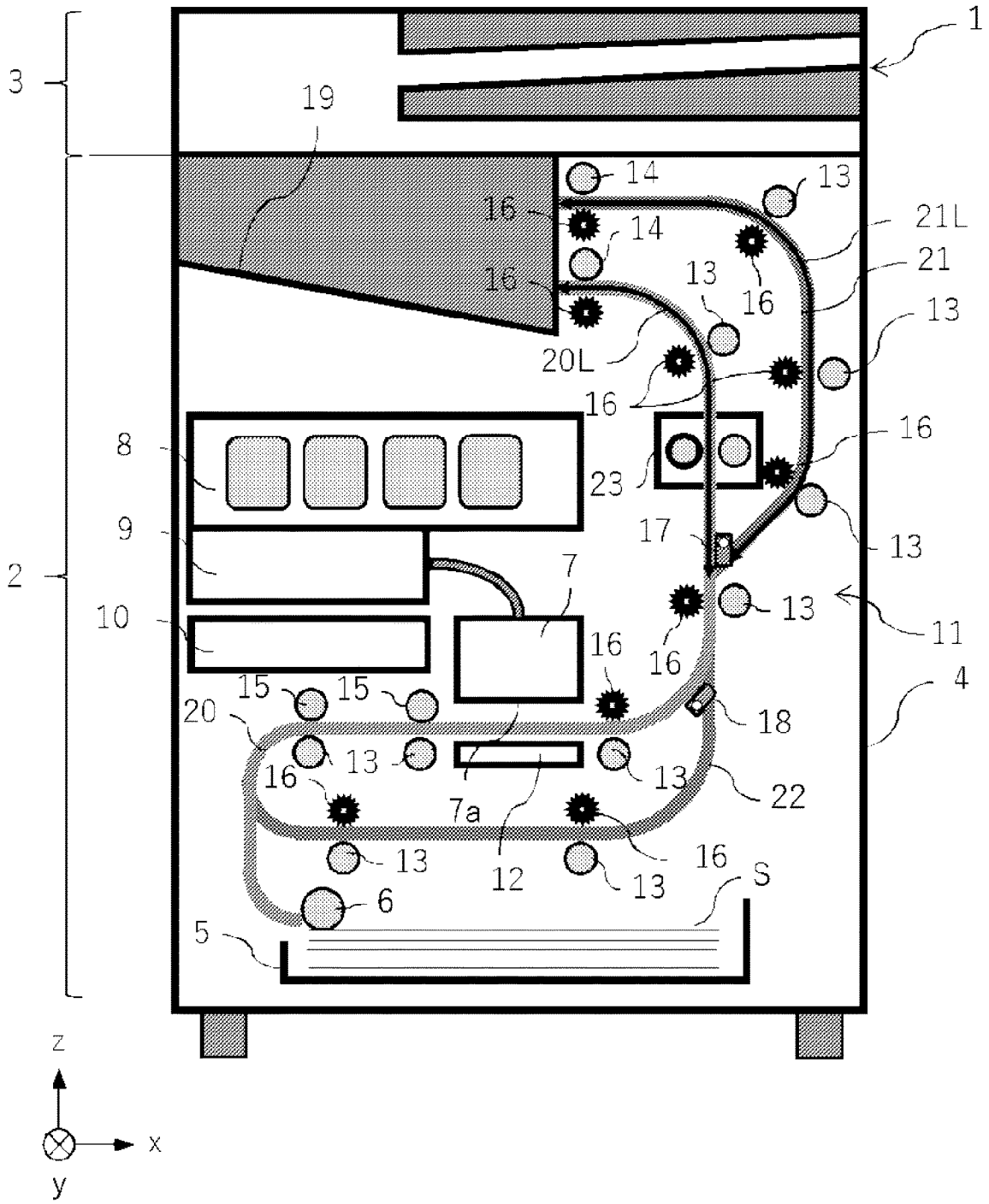
FIG. 1 is an internal configuration view of an ink jet recording apparatus of Embodiment 1.

FIG. 1 is an internal configuration view of an ink jet recording apparatus (below, a recording apparatus) 1 of Embodiment 1 of the present invention. From this point forward, in the drawings, the x direction denotes the horizontal direction; the y direction (direction perpendicular to the paper plane), the direction in which the discharge ports are arrayed in a recording head 7 described later; and the z direction, the vertical direction.

The recording apparatus 1 is a multi-purpose machine (image recording apparatus) including a print portion 2 as an image recording portion (image recording device), and a scanner portion 3 as an image reading portion (image reading device). The recording apparatus 1 can execute various processings regarding the recording operation and the reading operation at the print portion 2 and the scanner portion 3 separately or in conjunction with each other. The scanner portion 3 includes an ADF (auto document feeder) and a FBS (flat head scanner), and can perform reading of the document sheets to be automatically fed by the ADF, and reading (scanning) of the document sheets placed on the document sheet holder of the FBS by a user. Incidentally, the recording apparatus in accordance with the present embodiment is a multi-purpose machine having both the print portion 2 and the scanner portion 3, and may be in a form not having the scanner portion 3. The print portion 2 includes a housing 4, a cassette 5, a feed unit 6, a recording head 7, an ink tank unit 8, an ink feed unit 9, a maintenance unit 10, a conveyance unit 11, and the like.

The cassette 5 is for accommodating recording media S, and is at the bottom in the vertically downward direction of the housing 4, and is detachably set. The feed unit 6 is provided in the vicinity of the cassette 5, and separates the accommodated recording media S one by one, and feeds the recording media S for performing the recording operation. When the recording operation is performed, the recording medium S is fed from the cassette 5. Incidentally, the stacking portion of the recording media in the present invention is not limited to the cassette 5, and includes, for example, the paper feeding configuration using a so-called manual feeding tray capable of feeding paper from the side surface of the housing 4.

The recording head 7 is a full line type color ink jet recording head, in which discharge ports each for discharging an ink according to the recording data are arrayed in plural number corresponding to the width of the recording medium S along the y direction in FIG. 1. Further, the recording head 7 is movable, and the discharge port surface 7*a* of the recording head 7 moves to the position (which will be hereinafter referred to as the recording position) opposite to a platen 12 (described later) when the recording operation is performed.

The ink tank unit 8 stores each ink of four colors to be fed to the recording head 7. The ink feed unit 9 is provided partway in the passage for connecting the ink tank unit 8 and the recording head 7, and adjusts the pressure and the flow rate of each ink in the recording head 7 within the proper range. In the present embodiment, the circulation type ink feed system is adopted, and the ink feed unit 9 adjusts the pressure of each ink to be fed to the recording head 7 and the flow rate of each ink to be collected from the recording head 7 within the proper range.

The maintenance unit 10 performs the maintenance operation on the recording head 7. The maintenance unit 10 operates a cap unit and a wiping unit (not shown) at a prescribed timing, thereby performing maintenance.

The conveyance unit 11 includes elements for guiding the recording medium S in a prescribed direction, including the platen 12, a conveying roller 13, a discharge roller 14, a pinch roller 15, a spur 16, a first flapper 17, a second flapper 18, a heat drying portion 23, and the like.

The platen 12 is provided at the position opposite to the discharge port surface 7*a* of the recording head 7 during the recording operation as described above. Further, the platen 12 includes a plate extending in the y direction, and supports the recording medium S from the back surface so that the distance between the discharge port surface 7*a* and the recording medium S may become a prescribed value. In the following description, the region of the conveying path where the platen 12 is opposed to the recording head 7 will be referred to as a recording region (recording portion).

The conveying roller 13 is a drive roller for conveying the recording medium S on the conveying path, and is disposed partway in the conveying path. Incidentally, the conveying roller 13 is driven by a motor (not shown). The discharge roller 14 is a drive roller provided most downstream on the conveying path. Incidentally, the discharge roller 14 is driven by a motor (not shown). The pinch roller 15 is a roller opposed to and following the conveying roller 13 on the upstream side of the recording head 7, and rotates, nipping the recording medium S with the conveying roller 13. The spur 16 is opposed to, and follows the conveying roller 13 on the downstream side of the recording head 7, and rotates, nipping the recording medium S with the conveying roller 13.

As switching means for switching conveying paths for the recording medium S, the first flapper 17 switches the conveying destination of the recording medium S to either of a main conveying path 20 (first path) and a sub conveying path 21 (second path) at the branch part of the main conveying path 20 (first path) and the sub conveying path 21 (second path). Switching of the first flapper 17 is performed by an actuator (not shown). As switching means for switching conveying paths for the recording medium S, the second flapper 18 guides the conveying destination of the recording medium S to a reversal conveying path (third path) 22 (described later) for performing recording on the second surface after recording on the first surface. Switching of the second flapper 18 is performed by an actuator (not shown).

The heat drying portion (heating portion) 23 promotes drying of the recording medium S which has completely gone through the recording operation. This suppresses the deformation of the recording medium S due to the moisture of the ink, which results in the prevention of the jam in the conveying path, and an improvement of the aligning performance in a discharge tray (paper discharge tray) 19.

Figure 2:
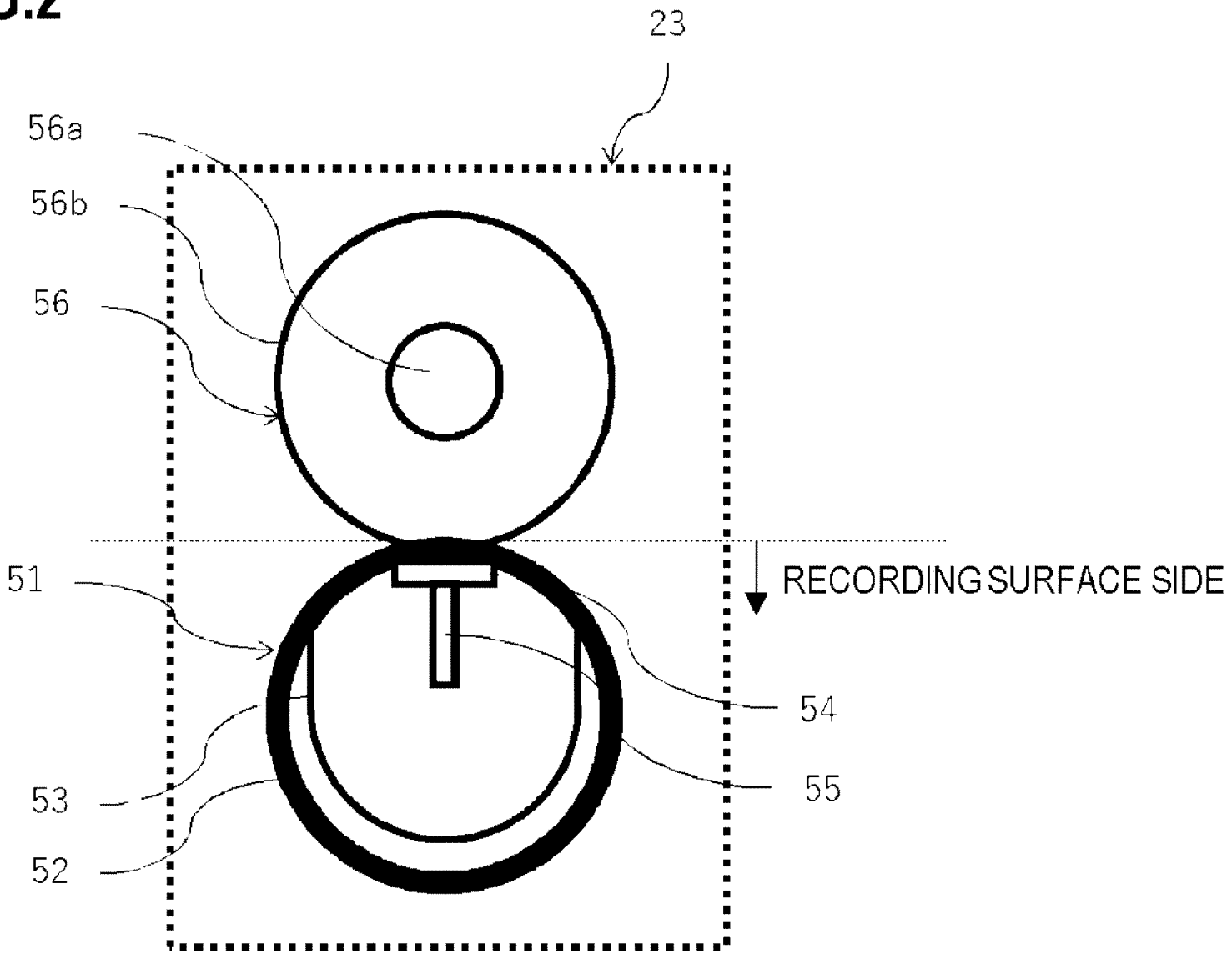
FIG. 2 is a cross sectional view of a heat drying portion.

FIG. 2 shows a detailed cross sectional view of the heat drying portion 23 of the present embodiment. The heat drying portion 23 includes a heat generation member 51 and a pressure roller 56, and these extend in the y direction so as to cover the width of the recording medium S with the maximum size. The heat generation member 51 includes a support member 53 for supporting a heating element 54. The heating element 54 is, for example, a ceramic heater, and extends in the y direction. The temperature of the heating element 54 is detected by a temperature sensor 55 typified by a thermistor. Driving of the heating element 54 is controlled based on the detection results. The support member 53 further supports a tubular film 52. The film 52 is formed in a cylindrical shape, and extends in the y direction. The film 52 has flexibility, and is supported by the support member 53 rotatably about the support member 53, and lies between the pressure roller 56 and the heating element 54. The film 52 is a monolayer film or a composite layer film with a film thickness of, for example, at least 10 μm and not more than 100 μm. In the case of the monolayer film, the material is, for example, PTFE, PFA, or FEP. In the case of the composite layer film, for example, the film is obtained by coating the layer of polyimide, polyamideimide, PEEK, PES, PPS, or the like with PTFE, PFA, FEP, or the like, or is a layer-structured film subjected to coating.

Incidentally, the heat generation member 51 is not limited to the foregoing configuration. For example, the structure is also acceptable in which a heating element such as a halogen heater is included in the inside of the core axis of a hollow metal, and an elastic body such as silicone rubber is coated around the core axis.

The pressure roller 56 is formed by coating the circumferential surface of the core metal 56*a* with an elastic body 56*b* such as silicone rubber. The pressure roller 56 is brought into pressure contact with the heat generation member 51 with a prescribed pressing force via the film 52, so that the pressure roller 56 and the heat generation member 51 form a nip portion between the pressure roller 56 and the film 52. The pressure roller 56 is rotated with a motor as a driving source, and the film 52 is rotated following the pressure roller 56. With such a configuration, the recording medium S is heated by coming in contact with the film 52 as a heating member heated by the heat generation member 51 while being conveyed at the nip portion, which can promote drying of the recording medium S.

Incidentally, the heat drying portion 23 may be not only the contact heating system shown in the present embodiment, but also, for example, the system for blowing warm air to the recording medium S (warm air system), or the system for promoting drying without contact with the recording medium S by providing an infrared heater in the vicinity of the recording medium S (non-contact heating system).

The conveying paths including the conveying unit 11 described up to this point include a main conveying path 20, a sub conveying path 21, and a reversal conveying path 22.

The main conveying path 20 is the conveying path for conveying the recording media S through the stacking portion, the recording portion, the heat drying portion, and the discharge portion in this order. Specifically, the main conveying path 20 is the conveying path passing from the feed unit 6 through the recording region including the recording head 7 and the platen 12, and passing through the heat drying portion 23 and the conveying roller 13, and the discharge roller 14, and extending to the discharge tray 19. The recording medium S discharged through the main conveying path 20 is put in a state in which drying is promoted by the action of the heat drying portion 23.

The sub conveying path 21 is a conveying path formed by being branched off from between the recording region and the heat drying portion 23 in the main conveying path 20, and running through the conveying roller 13 toward the discharge tray 19. The sub conveying path 21 does not include the heat drying portion 23, and the recording medium S not to be subjected to heat drying is to be conveyed on the sub conveying path 21. Incidentally, switching of the conveying path between the main conveying path 20 and the sub conveying path 21 is performed by the first flapper 17 disposed at the branch part (first branch part) of the main conveying path 20 and the sub conveying path 21 as described above.

The reversal conveying path 22 is a conveying path branching off from between the recording region and the first flapper 17 in the main conveying path 20, and connected to the upstream side in the conveying direction of the recording region, and is used as the conveying path before recording on the second surface of the recording medium S. The recording medium S on the reversal conveying path 22 is conveyed by the spur 16 opposed to the conveying roller 13. The branch part (second branch part) of the main conveying path 20 and the reversal conveying path 22 is provided with a second flapper 18, which performs the switching operation so as to guide the recording medium S to the reversal conveying path 22 for performing recording on the second surface after performing recording on the first surface.

Incidentally, the recording apparatus 1 in the present embodiment is configured assuming that the conveying path for heat drying the recording medium S is mainly used. For this reason, it is generally configured that the conveying path length has the relationship of 20L≤21L, where 20L represents the conveying path length (the length of the conveying path) on the downstream side in the conveying direction from the first branch part from the sub conveying path 21 of the main conveying path 20, and 21L represents the conveying path length of the sub conveying path 21. As a result, it is possible to shorten the time for a series of operations from paper feeding to discharge when the heat drying portion 23 is assumed to be used in the recording operation.

Figure 3:
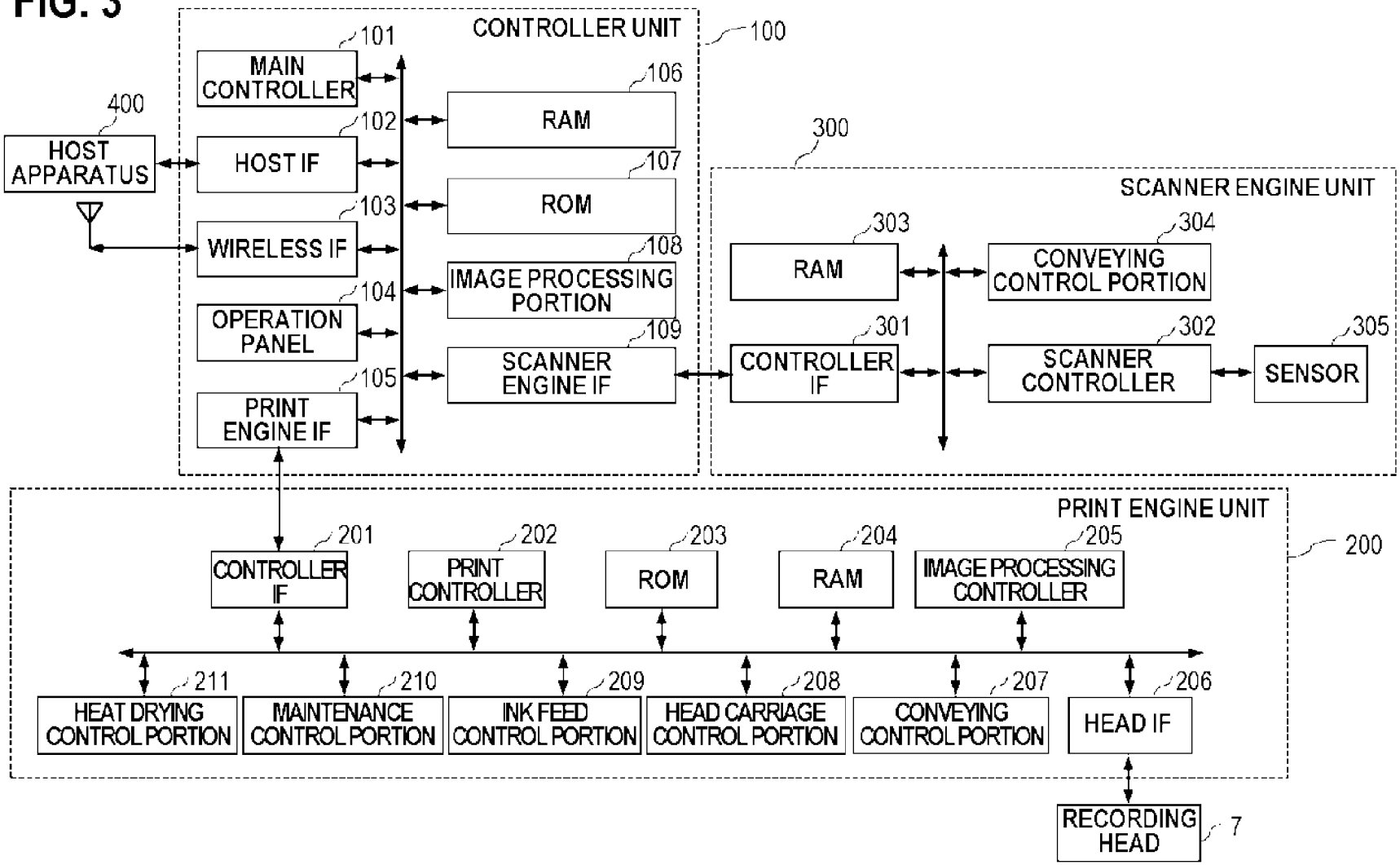
FIG. 3 is a block diagram showing the control configuration in the recording apparatus.

FIG. 3 is a block diagram showing the control configuration in the recording apparatus 1. The control configuration mainly includes a print engine unit 200 for supervising the print portion 2, a scanner engine unit 300 for supervising the scanner portion 3, and a controller unit 100 for supervising the whole recording apparatus 1. The print controller 202 controls various mechanisms of the print engine unit 200 according to the directions from the main controller 101 of the controller unit 100. The various mechanisms of the scanner engine unit 300 are controlled by the main controller 101 of the controller unit 100. Below, the details of the control configuration will be described.

In the controller unit 100, the main controller 101 formed of a CPU controls the whole recording apparatus 1 with a RAM 106 as a work area according to the programs and various parameters stored in a ROM 107. For example, when a print job is inputted from a host apparatus 400 via a host I/F 102 or a wireless I/F 103, the image data received by an image processing portion 108 is subjected to prescribed image processing according to the directions from the main controller 101. Then, the main controller 101 transmits the image data subjected to image processing to the print engine unit 200 via a print engine I/F 105.

Incidentally, the recording apparatus 1 may acquire image data from the host apparatus 400 via radio communication or wire communication, or may acquire image data from an external storage device (such as a USB memory stick) connected to the recording apparatus 1. The communication system for use in radio communication or wire communication has no restriction. For example, as the communication system for use in radio communication, Wi-Fi (Wireless Fidelity) (registered trademark) or the Bluetooth (registered trademark) is applicable. Further, as the communication system for use in wire communication, USB (Universal Serial Bus), or the like is applicable. Further, for example, when a read command is inputted from the host apparatus 400, the main controller 101 transmits the command to the scanner portion 3 via a scanner engine I/F 109.

An operation panel 104 is the mechanism for a user to perform input/output to/from the recording apparatus 1. A user can instruct the operations such as copying and scanning, can set the print mode, and can recognize the information of the recording apparatus 1 via the operation panel 104.

In the print engine unit 200, the print controller 202 formed of a CPU controls various mechanisms included in the print portion 2 with a RAM 204 as the work area according to the programs and various parameters stored in a ROM 203. When various commands and image data are received via a controller I/F 201, the print controller 202 stores this in the RAM 204 once. The print controller 202 causes an image processing controller 205 to convert the stored image data into recording data, so that the recording head 7 can use the recording data for the recording operation.

When recording data is generated, the print controller 202 causes the recording head 7 to execute the recording operation based on the recording data via a head I/F 206. At this step, the print controller 202 drives the feed unit 6, the conveying roller 13, the discharge roller 14, the first flapper 17, and the second flapper 18 shown in FIG. 1 via a conveying control portion 207, and conveys the recording medium S. The recording operation by the recording head 7 is executed in conjunction with the conveying operation of the recording medium S according to the directions of the print controller 202, and print processing is performed.

A heat drying control portion 211 performs driving control of the heating element 54 and the pressure roller 56 of the heat drying portion 23 when heat drying of the recording medium S is performed. Whether heat drying is performed or not is selected, for example, according to whether or not the recording operation on the first surface or the second surface is performed, the kind of the recording medium S, and the amount of the ink discharged to the recording medium S using the flowchart shown in FIG. 4.

Figure 4:
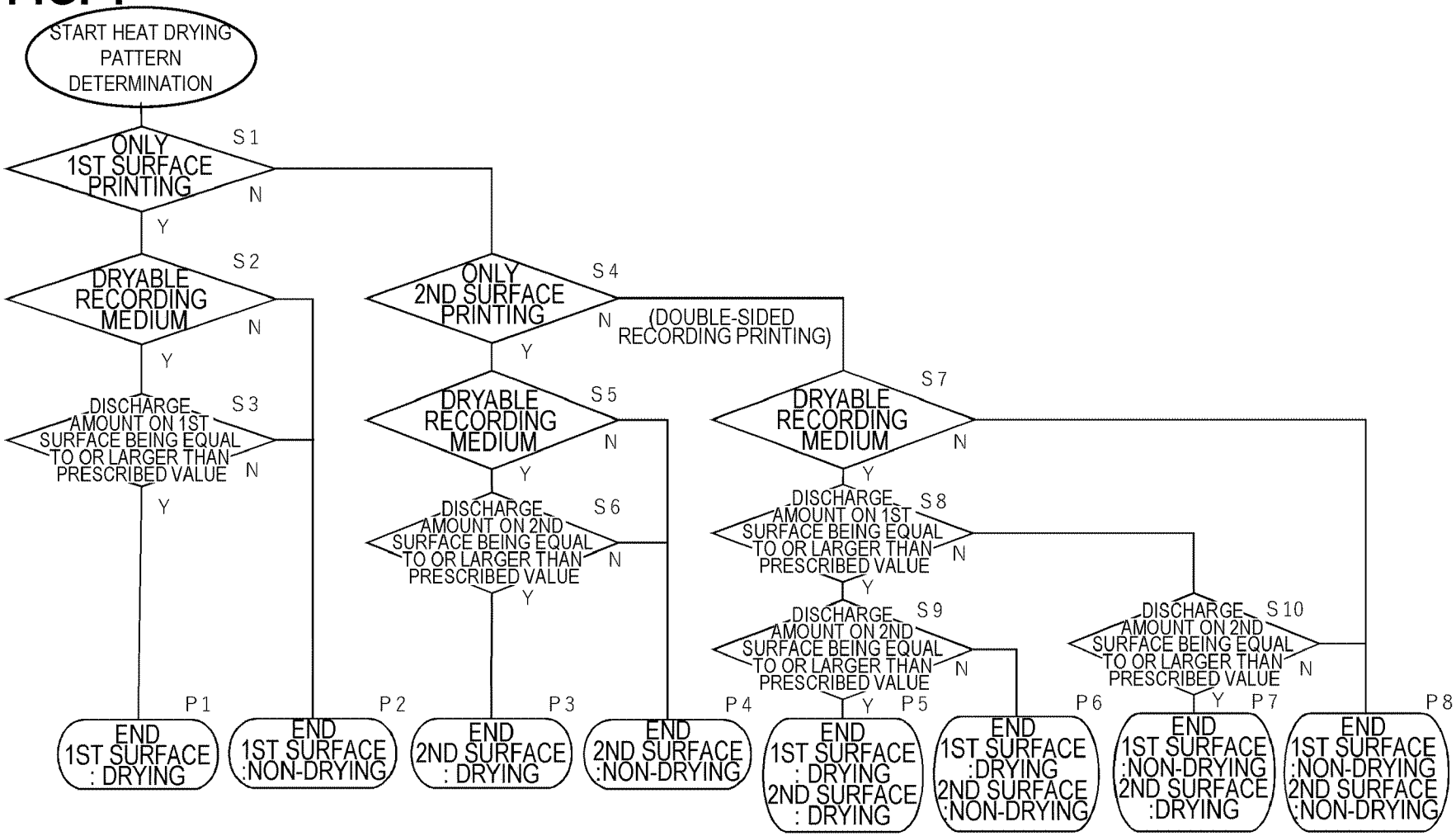
FIG. 4 is a flowchart showing the heat drying patterns.

FIG. 4 is a flowchart showing one example of the determination control of the heat drying pattern in the present embodiment. When the printed surface is only the first surface (S1: Y), and the recording medium S is suitable for heat drying (S2: Y), whether heat drying is performed or not is determined according to whether the ink discharge amount onto the first surface is at least a prescribed value, or not (S3). Examples of the recording medium S not suitable for heat drying may include a heat sensitive sheet such as an OHP film, glossy paper having a coating layer on the surface thereof, and an adhesive envelope. When heat drying is required to be carried out because the recording medium is a recording medium S capable of being heat dried, and the ink discharge amount is at least a prescribed value (S3: Y), a pattern 1 of heat drying the first surface is selected (P1). When the recording medium is not suitable for heat drying (S2: N), or when the ink discharge amount is the amount not enough to require heat drying (less than a prescribed value) even if the recording medium S is suitable for heat drying (S3: N), a pattern 2 of not heat drying the first surface is selected (P2).

When the printed surface is not only the first surface, but is only the second surface (S1: N, S4: Y), namely, when image recording is performed only on the second surface, as with whether heat drying of the first surface is required to be carried out or not described above, it is determined whether heat drying on the second surface is required to be carried out or not. Namely, when the recording medium S is suitable for heat drying, and the ink discharge amount onto the second surface is at least a prescribed value requiring heat drying (S5: Y, S6: Y), a pattern 3 of carrying out heat drying on the second surface is selected (P3). When the recording medium S is not suitable for heat drying (S5: N), or when the ink discharge amount is the amount (less than a prescribed value) not enough to require heat drying even if the recording medium S is suitable for heat drying (S6: N), a pattern 4 of not heat drying the second surface is selected (P4).

Also when the printed surface is not only the first surface, and is not only the second surface (S1: N, S4: N), namely, when image recording is performed on both the surfaces of the first surface and the second surface, whether or not heat drying is required to be carried out is determined in the same manner as the determination of necessity described above. Namely, when the recording medium S is suitable for heat drying, the ink discharge amount onto the first surface is at least a prescribed value, and the ink discharge amount onto the second surface is at least a prescribed value (S7: Y, S8: Y, S9: Y), a pattern 5 of heat drying both the surfaces of the first surface and the second surface is selected (P5). Further, when the recording medium S is suitable for heat drying, and the ink discharge amount onto the first surface is equal to or larger than a prescribed value, but the ink discharge amount onto the second surface is at least a prescribed value (S7: Y, S8: Y, S9: N), a pattern 6 of heat drying only the first surface is selected (P6). When the recording medium S is suitable for heat drying, and the ink discharge amount onto the first surface is less than a prescribed value, and the ink discharge amount onto the second surface is at least a prescribed value (S7: Y, S8: N, S10: Y), a pattern 7 of heat drying only the second surface is selected (P7). When the recording medium S is not suitable for heat drying (S7: N), or when either of the ink discharge amounts onto the first surface and the second surface is less than a prescribed value (S7: Y, S8: N, and S10: N), a pattern 8 of heat drying neither of the first surface and the second surface, and discharging the recording medium S is selected (P8).

Incidentally, whether the recording medium S is heat dried or not is not limited to this, and can also be arbitrarily selected by a user with the operation panel 104.

A head carriage control portion 208 changes the position of the recording head 7 according to the operation state such as the maintenance state or the recording state of the recording apparatus 1. An ink feed control unit 209 controls the ink feed unit 9 so that the pressure of each ink to be fed to the recording head 7 may fall within a proper range. A maintenance control portion 210 controls the operation of the maintenance unit 10 when performing the maintenance operation on the recording head 7.

In the scanner engine unit 300, the main controller 101 controls the hardware resources of a scanner controller 302 with the RAM 106 as the work area according to the programs and various parameters stored in the ROM 107. As a result, various mechanisms included in the scanner portion 3 are controlled. For example, the main controller 101 controls the hardware resources in the scanner controller 302 via a controller I/F 301, so that the document sheets mounted on an ADF are conveyed by a user via a conveying control portion 304, and are read by a sensor 305. Then, the scanner controller 302 stores the read image data in a RAM 303. Incidentally, the print controller 202 converts the image data acquired as described above into recording data, and thereby can cause the recording head 7 to execute the recording operation based on the image data read at the scanner controller 302.

Then, a description will be given to the conveying path for the recording medium S in the print portion 2. FIG. 5 shows the patterns of the conveying paths by the combinations of the recording surfaces and whether heat drying is performed or not, and the total number of the patterns is 8. Below, the conveying path for the recording medium S in each pattern will be described in detail. First, the pattern 1 (recorded surface: first surface, heat drying: first surface) will be described. When a record command is inputted, the print controller 202 moves the recording head 7 to the recording position using the maintenance control portion 210 and the head carriage control portion 208. Further, the print controller 202 performs heating of the heat generation member 51 and driving of the pressure roller 56 at the heat drying portion 23 using the heat drying control portion 211, resulting in a state in which heat drying of the recording medium S can be performed. Subsequently, the print controller 202 drives the feed unit 6 using the conveying control portion 207 according to a record command.

The recording medium S stacked uppermost in the cassette 5 is separated from second and subsequent recording media S by the feed unit 6, and is conveyed toward the recording region between the platen 12 and the recording head 7 while being nipped by the conveying roller 13 and the pinch roller 15 in the main conveying path 20.

In the recording region, respective inks are discharged from a plurality of discharge ports provided at the recording head 7 toward the recording medium S. The recording medium S after being applied with an ink is conveyed to the downstream side in the conveying direction while being guided by the conveying roller 13 and the spur 16 on the downstream side of the recording head 7. Thereafter, the recording medium S is guided to the main conveying path 20 having the heat drying portion 23 by the switching operation of the first flapper 17, and passes through the heat drying portion 23, resulting in a state in which drying has been promoted. Finally, the recording medium S is stacked on the discharge tray 19 by the discharge roller 14.

Then, the pattern 2 (recorded surface: first surface, heat drying: none) will be described. The operation from feeding to the recording operation on the first surface is the same as that of the pattern 1. Subsequently, the recording medium S is guided to the sub conveying path 21 not having the heat drying portion 23 by the switching operation of the first flapper 17, and is stacked on the discharge tray 19 by the conveying roller 13 on the sub conveying path 21 and the discharge roller 14 as a second discharge portion.

Then, the pattern 3 (recorded surface: second surface, heat drying: second surface) will be described. The operation from feeding to the recording operation is the same as those of the patterns 1 and 2, and the recording operation on the first surface in the recording region is not performed. Subsequently, the recording medium S is guided to the sub conveying path 21 not having the heat drying portion 23 as with the pattern 2. When the terminal end of the recording medium S reaches the downstream side in the conveying direction of the second flapper 18, the operation of conveying the second surface to the recording region is started. Specifically, the switching operation of the second flapper 18 for guiding the recording medium S to the reversal conveying path 22, the reversal operation (counter rotation operation) of the conveying roller 13 on the sub conveying path 21, and the reversal operation of the conveying roller 13 on the main conveying path 20 for relaying the sub conveying path 21 and the reversal conveying path 22 are performed. The conveying direction of the recording medium S is reversed by the switch back operation, and the recording medium S is guided to the reversal conveying path 22. As a result, the recording medium S is put in a state in which the to-be-recorded surface (recorded surface) is inverted from the first surface to the second surface. The recording medium S guided to the reversal conveying path 22 is guided to the main conveying path 20 again on the upstream side of the recording head 7 by the conveying roller 13 and the spur 16 on the reversal conveying path 22, and the recording operation on the second surface is performed in the recording region. Thereafter, the recording medium S passes through the heat drying portion 23 on the main conveying path 20, and is stacked in the discharge tray 19 as with the pattern 1. Incidentally, of a plurality of conveying rollers 13 arranged on respective conveying paths, the reversibly rotatably configured roller may be only the roller involved in the switch back operation. Incidentally, the configuration was adopted in which the recording medium S is inverted on the sub conveying path 21. However, not limited to this, it may be configured that the recording medium S is inverted after passing through the heat drying portion 23 of the main conveying path 20 even without performing recording on the first surface. In this case, the recording medium S passes through the heat drying portion 23, resulting in an increase in temperature of the recording medium S. This can promote drying of the moisture of the ink applied to the second surface.

Then, the pattern 4 (recorded surface: the second surface, heat drying: none) will be described. The operation from feeding to the recording operation on the second surface is the same as that of the pattern 3. Subsequently, the recording medium S passes through the sub conveying path 21, and is stacked in the discharge tray 19 as with the pattern 2.

Figures 6A, 6B, 6C, 6D, 6E, 6F:
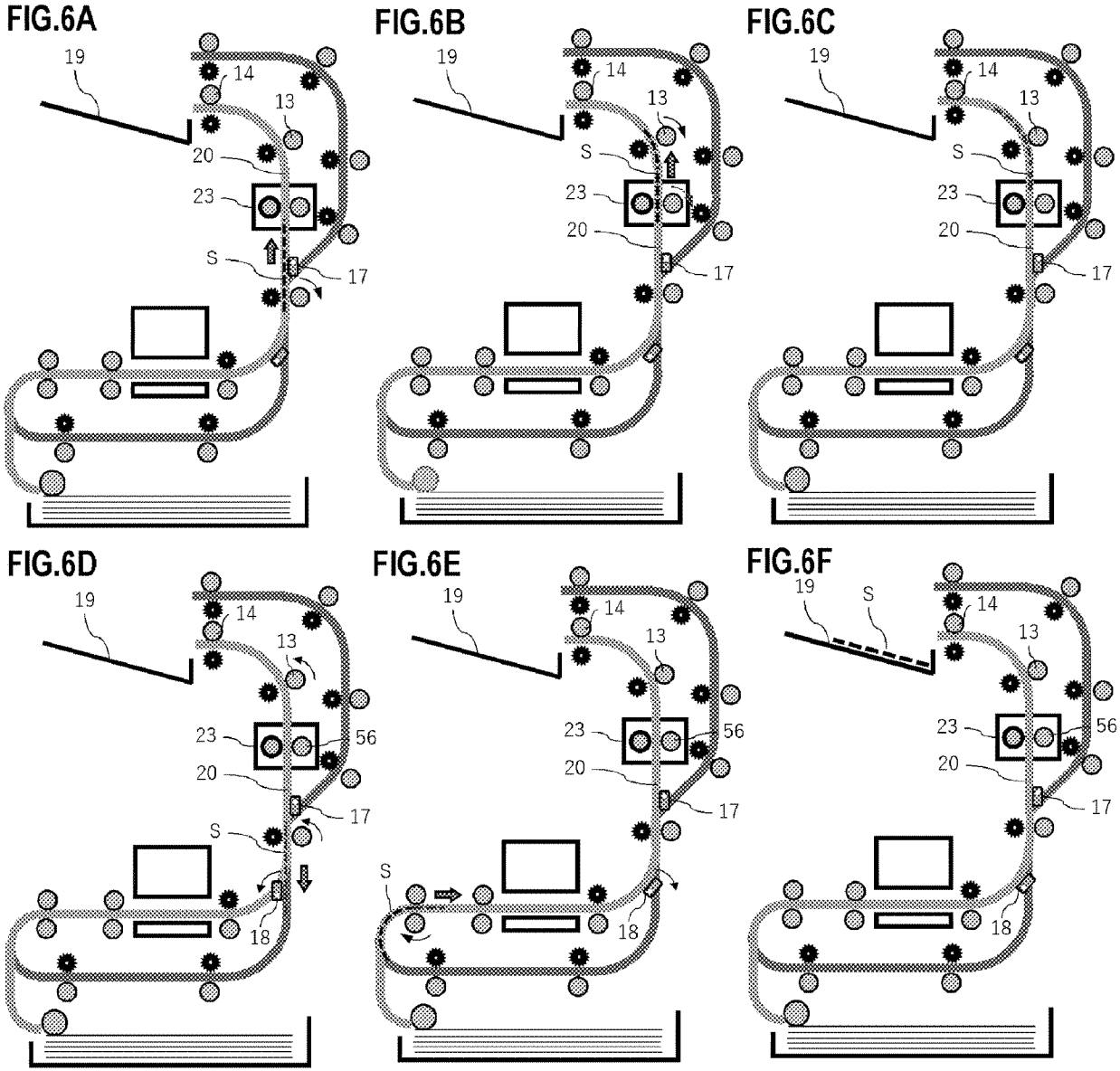
FIGS. 6A to 6F are views showing the conveying path for a recording medium in a pattern 5.

Then, the pattern 5 (recorded surface: both surfaces, heat drying: both surfaces) will be described. FIGS. 6A to 6F show the conveying path for the recording medium S for double-sided recording and double-sided drying. First, the recording operation and the heat drying operation on the first surface are performed. The operation from feeding to the recording operation on the first surface is the same as those of the patterns 1 and 2. The recording medium S is guided to the main conveying path 20, and is conveyed toward the heat drying portion 23 (FIG. 6A). The recording medium S passes through the heat drying portion 23, which promotes drying of the first surface (FIG. 6B). At the stage at which the terminal end of the recording medium S has passed through the heat drying portion 23, the forward rotation of the conveying roller 13 is stopped (FIG. 6C). Then, the recording operation and heat drying operation on the second surface are performed. The second flapper 18 is subjected to a switching operation so that the recording medium S is guided to the reversal conveying path 22, and the conveying roller 13 and the pressure roller 56 on the main conveying path 20 up to the reversal conveying path 22 are counter-rotated. As a result, the recording medium S is guided to the reversal conveying path 22 (FIG. 6D). The recording medium S guided to the reversal conveying path 22 is guided to the main conveying path 20 again on the upstream side of the recording head 7 (FIG. 6E). In the recording region, the recording operation on the second surface is performed. The recording medium S which has completely gone through the recording operation on the second surface is guided to the main conveying path 20 again by the first flapper 17 and the second flapper 18, and passes through the heat drying portion 23. As a result, the second surface is also stacked on the discharge tray 19 with heat drying promoted.

Then, the pattern 6 (recorded surface: both surfaces, heat drying: the first surface) will be described. The operation from feeding to the recording operation on the second surface is the same as that of the pattern 5. Subsequently, the operation until the recording medium S is stacked on the discharge tray 19 is the same as the transport method on the sub conveying path 21 of the patterns 2 and 4.

Then, the pattern 7 (recorded surface: both surfaces, heat drying: the second surface) will be described. The operation from feeding to the recording operation on the second surface is the same as that of the pattern 3, except for performing the recording operation on the first surface. Subsequently, the operation until the recording medium S is stacked on the discharge tray 19 is the same as the transport method on the main conveying path 20 of the patterns 1, 3, and 5.

Figures 7A, 7B, 7C, 7D, 7E, 7F:
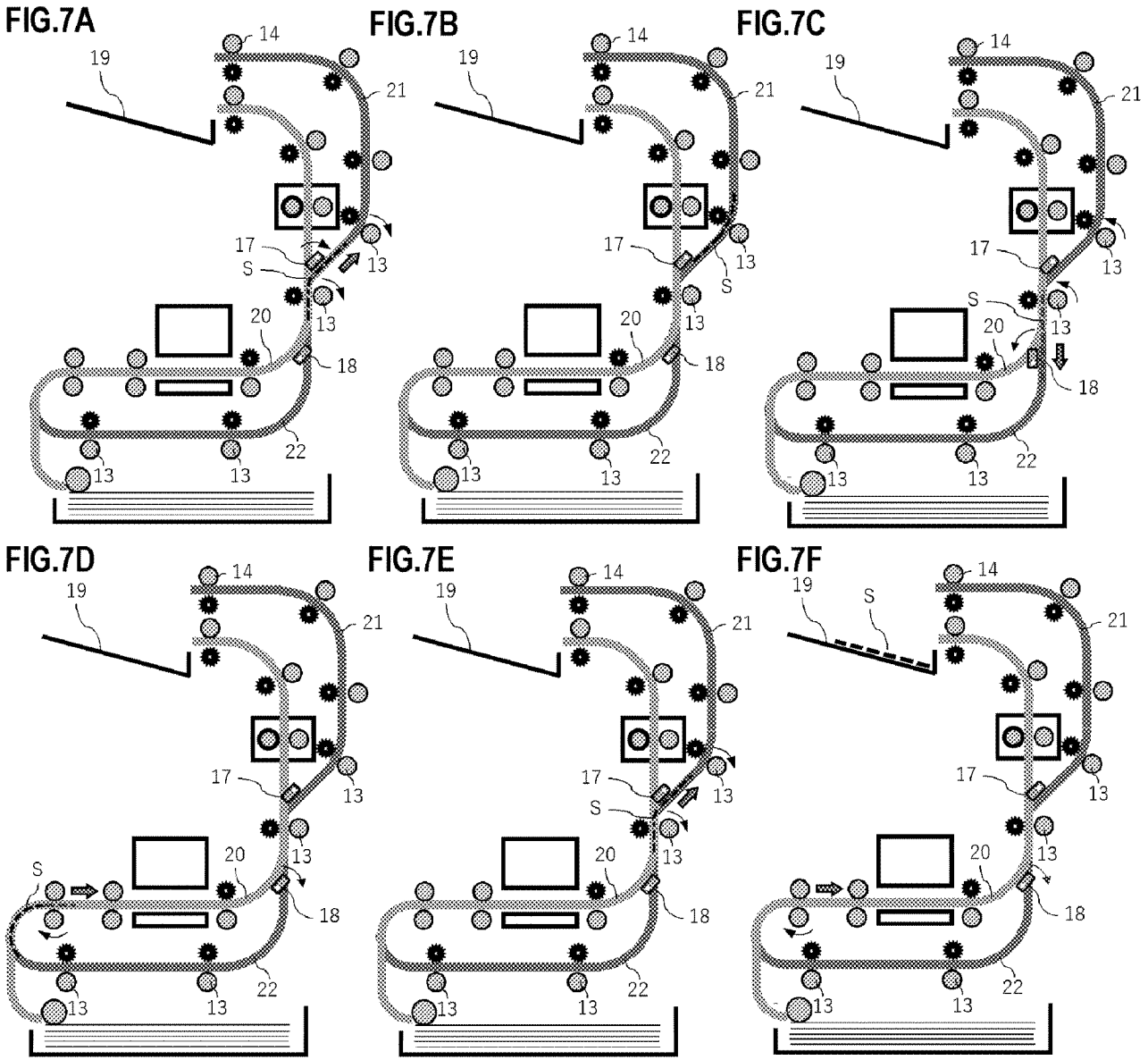
FIGS. 7A to 7F are views showing the conveying path for a recording medium in a pattern 8.

Then, the pattern 8 (recorded surface: both surfaces, heat drying: none) will be described. FIGS. 7A to 7F show the conveying path for the recording medium S for double-sided recording and for no heat drying. First, the recording operation on the first surface is performed. The operation from feeding to the recording operation on the first surface is the same as those of the patterns 1, 2, 5, 6, and 7. The recording medium S is guided to the sub conveying path 21 by the switching operation of the first flapper 17 (FIG. 7A). At the stage at which the terminal end of the recording medium S has passed through the first flapper 17, the forward rotation of the conveying roller 13 is stopped (FIG. 7B). Then, the recording operation on the second surface is performed. The second flapper 18 is subjected to the switching operation so that the recording medium S is guided to the reversal conveying path 22, and the conveying roller 13 on the sub conveying path 21, and the conveying roller 13 between the first flapper 17 and the second flapper 18 on the main conveying path 20 are counter-rotated. As a result, the recording medium S is guided to the reversal conveying path 22 (FIG. 7C). The recording medium S guided to the reversal conveying path 22 is guided to the main conveying path 20 again on the upstream side of the recording head 7 (FIG. 7D). In the recording region, the recording operation on the second surface is performed. The recording medium S which has completely gone through the recording operation on the second surface is guided to the sub conveying path 21 again by the first flapper 17 and the second flapper 18 (FIG. 7E), and the second surface is also stacked on the discharge tray 19 without performing heat drying (FIG. 7F).

Incidentally, with the heat drying portion 23, when it is determined from the recording information and the like that the recording medium S does not pass through the heat drying portion 23 as with the patterns 2, 4, and 8, the heat drying portion 23 is prevented from being operated. As a result, the power consumption can be reduced. For example, power supply to the heat generation member 51 is stopped, and heating of the heat generation member 51 is not performed. Alternatively, a stand-by state is kept in which electric power supply to the heat generation member 51 is limited to a prescribed preparatory heating. Further, the rotational driving of the pressure roller 56 is not performed. As a result, the effects can be more expected.

Embodiment 2

Figure 8:
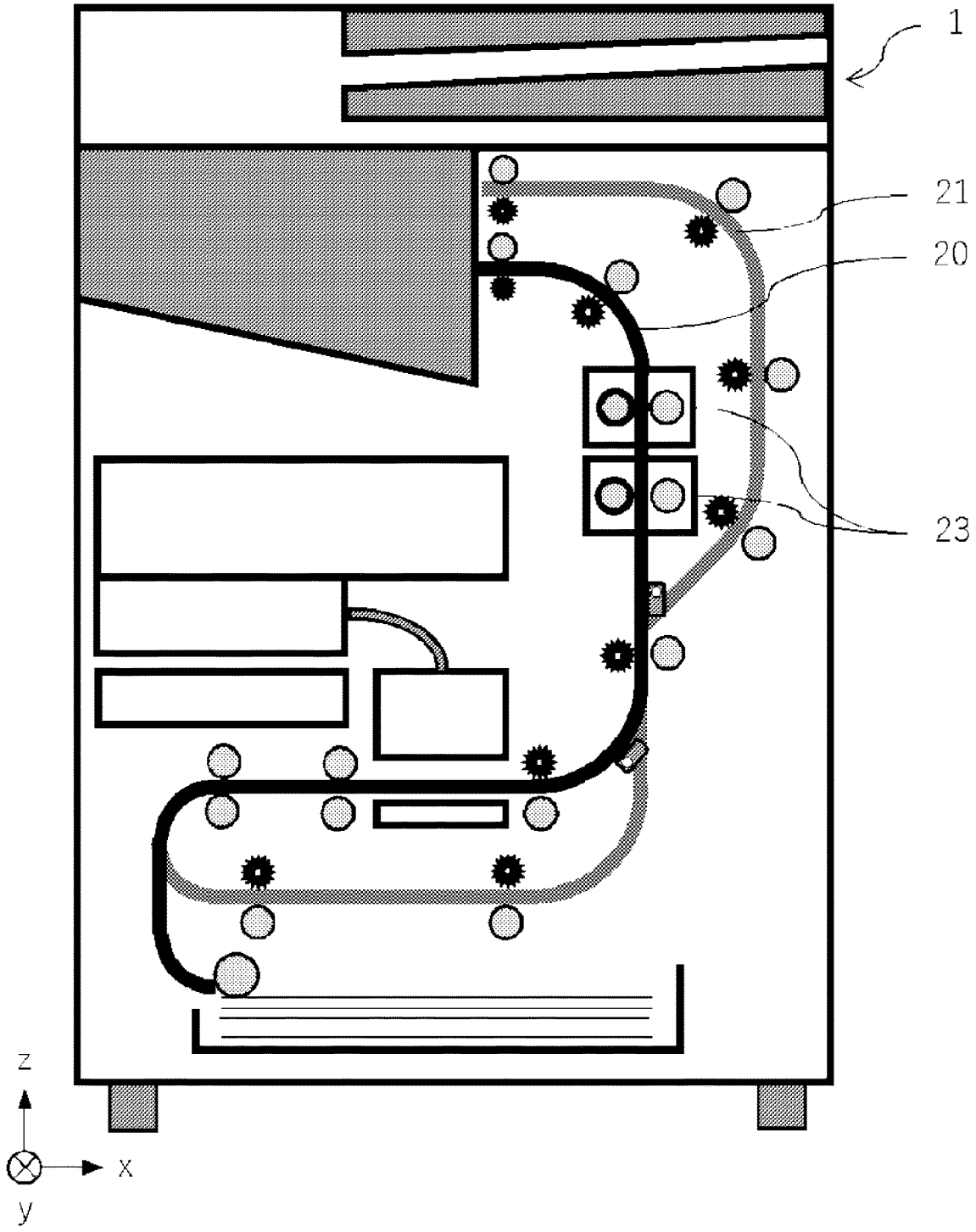
FIG. 8 is an internal configuration view of an ink jet recording apparatus of Embodiment 2.

FIG. 8 is an internal configuration view of a recording apparatus of Embodiment 2 of the present invention. The configuration common to that of Embodiment 1 in Embodiment 2 is given the same reference numerals and signs, and is not described. The matters herein not particularly described in Embodiment 2 are the same as those in Embodiment 1. In Embodiment 1, only one heat drying portion 23 is provided for the main conveying path 20. However, in Embodiment 2, a plurality of heat drying portions 23 are provided. As a result, heat drying of the recording medium S can be performed more efficiently, so that a recording pattern applied with a large amount of ink, a recording medium S susceptible to permeation of an ink thereinto, and the like can be dealt with. Incidentally, it may be configured such that a plurality of heat drying portions have mutually different control conditions of heating control and heating systems.

Embodiment 3

Figure 9:
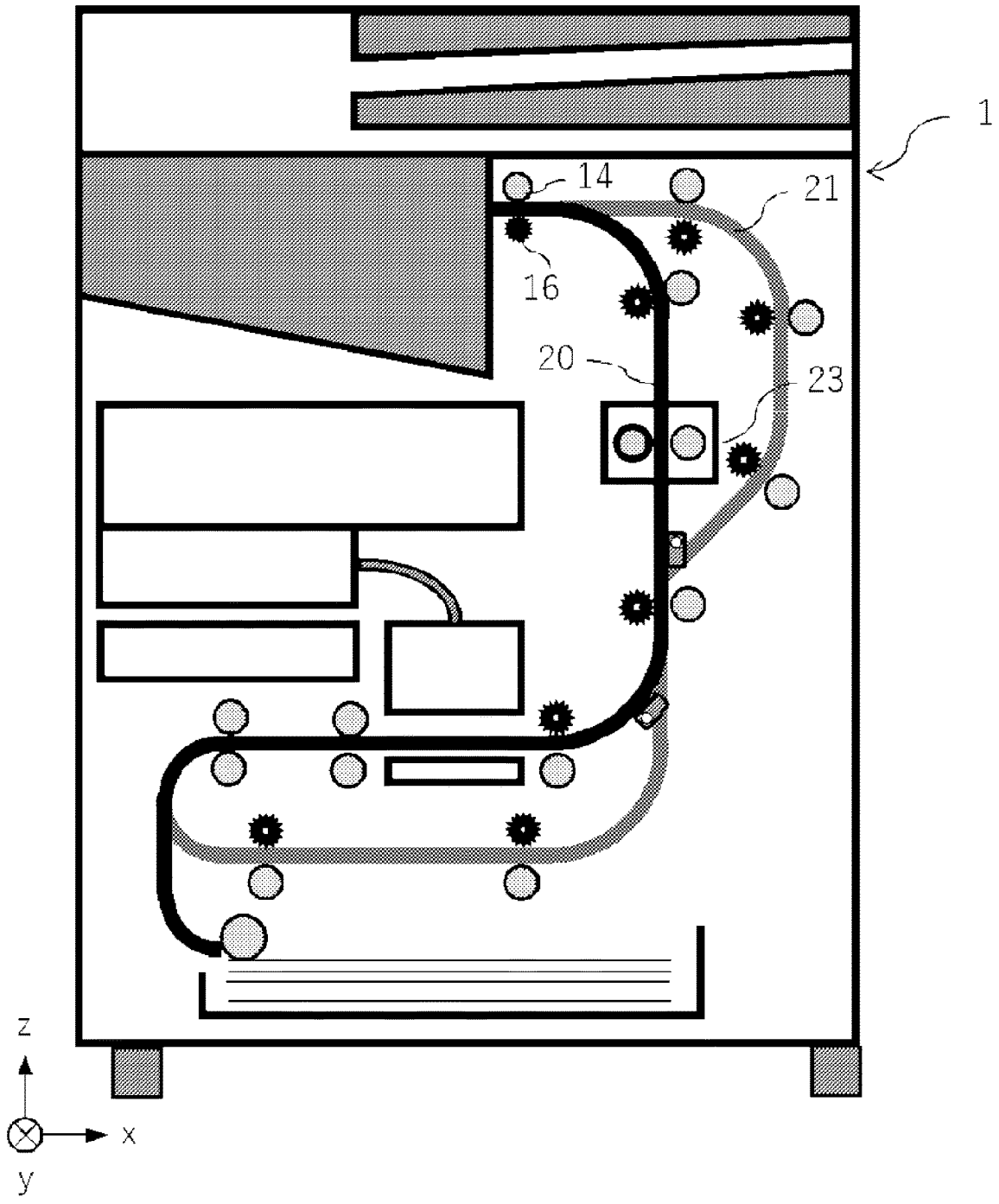
FIG. 9 is an internal configuration view of an ink jet recording apparatus of Embodiment 3.

FIG. 9 is an internal configuration view of a recording apparatus of Embodiment 3 of the present invention. The configuration common to those of Embodiments 1 and 2 in Embodiment 3 is given the same reference numerals and signs, and is not described. The matters herein not particularly described in Embodiment 3 are the same as those in Embodiments 1 and 2. In Embodiment 1 or 2, the main conveying path 20 and the sub conveying path 21 are provided as independent conveying paths up to the discharge tray 19. In the present embodiment, the sub conveying path 21 branching off from the main conveying path 20 is merged with the main conveying path 20 again. This results in a decrease in number of the conveying paths, which can reduce the number of members such as the discharge roller 14 and the spur 16. As a result, compactification and cost reduction of the apparatus can be implemented.

Embodiment 4

Figure 10:
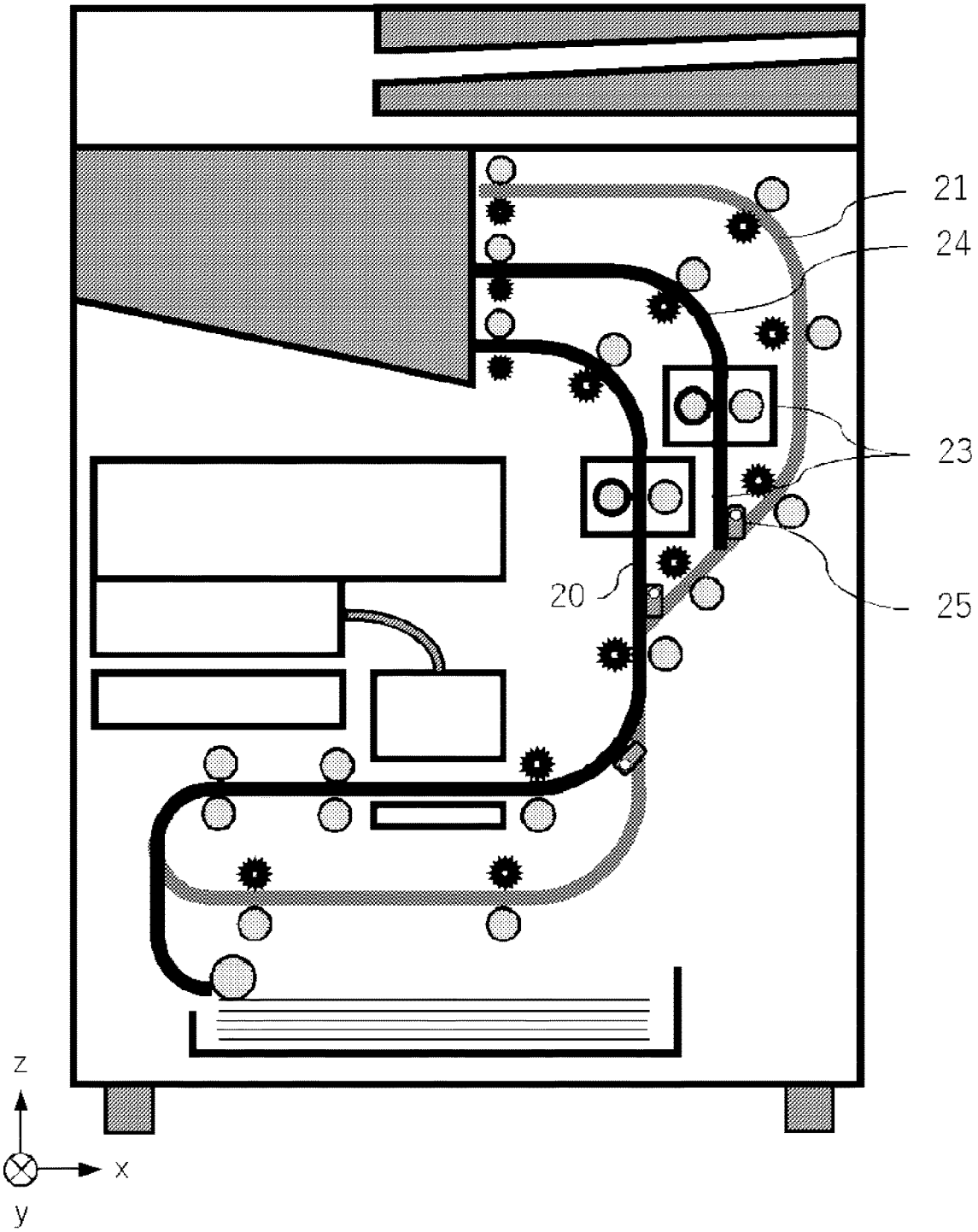
FIG. 10 is an internal configuration view of an ink jet recording apparatus of Embodiment 4.

FIG. 10 is an internal configuration view of a recording apparatus of Embodiment 4 of the present invention. The configuration common to those of Embodiments 1 to 3 in Embodiment 4 is given the same reference numerals and signs, and is not described. The matters herein not particularly described in Embodiment 4 are the same as those in Embodiments 1 to 3. In Embodiments 1 to 3, the conveying path on the downstream side in the conveying direction of the first flapper 17 includes, but not limited to, two of the main conveying path 20 and the sub conveying path 21. In the present embodiment, a second sub conveying path (fourth path) 24 branching off from the sub conveying path 21 is provided, and further, on the second sub conveying path 24, a heat drying portion 23 as a second heat drying portion is provided. Switching of the conveying path between the sub conveying path 21 and the second sub conveying path 24 is performed by a third flapper 25 provided at the branch part (third branch part) of the sub conveying path 21 and the second sub conveying path 24. The control conditions such as the optimum temperature for heat drying vary according to the basis weight and the thickness of the recording medium S, the permeation speed of the ink, and the like. For example, the setting temperature of the heat drying portion 23 on the second sub conveying path 24 is set relatively lower than the setting temperature of the heat drying portion 23 on the main conveying path 20. As a result, it becomes possible to select the optimum conveying path according to the recording medium S. Further, also for the heating system, it may be configured such that the heat drying portion 23 on the main conveying path 20 and the heat drying portion 23 on the second sub conveying path 24 use respectively different heating systems. As a result, it becomes possible to select the optimum conveying path according to the recording medium S.

Embodiment 5

Figure 11:
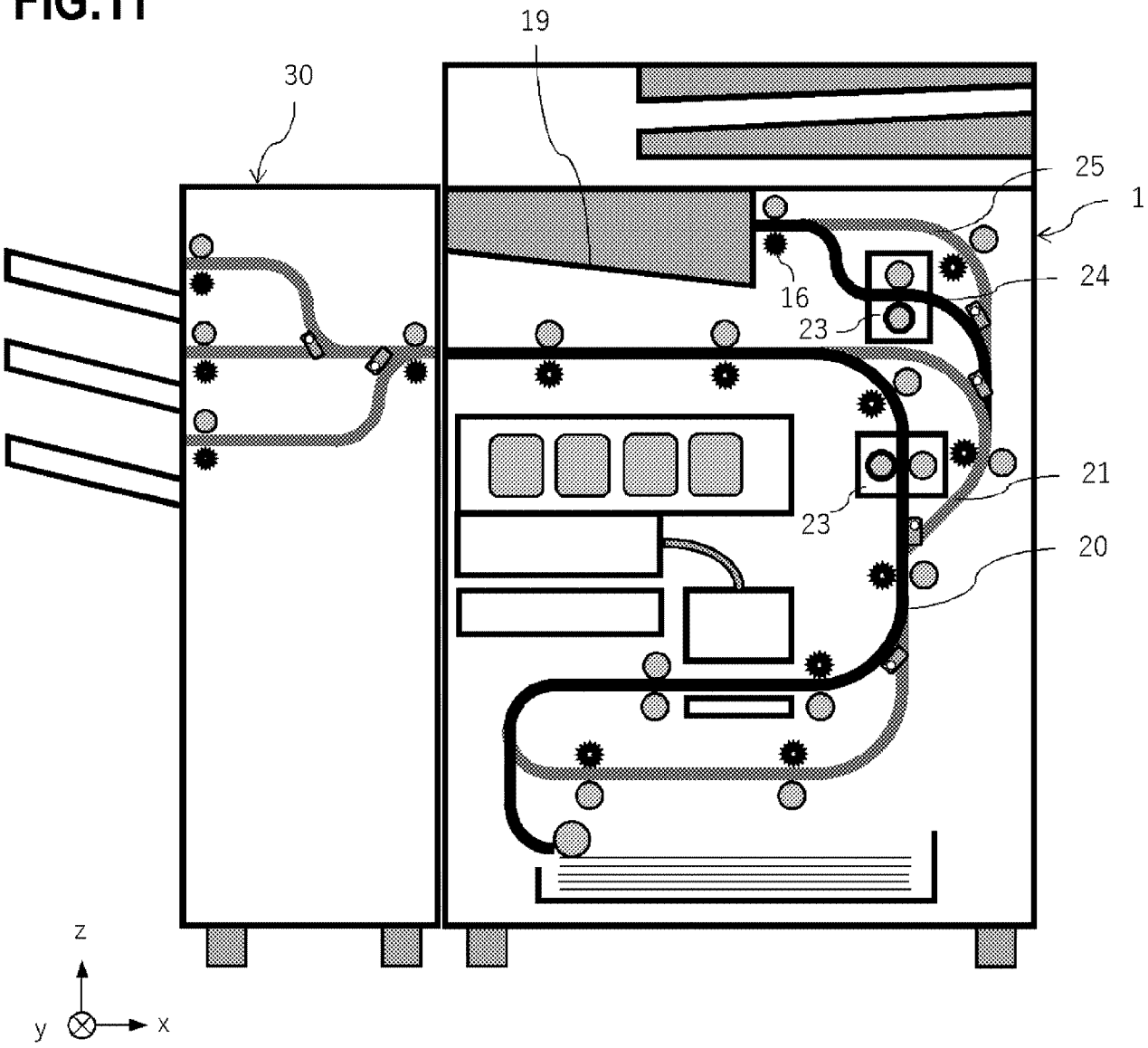
FIG. 11 is an internal configuration view of an ink jet recording apparatus of Embodiment 5.

FIG. 11 is an internal configuration view of a recording apparatus of Embodiment 5 of the present invention. The configuration common to those of Embodiments 1 to 4 in Embodiment 5 is given the same reference numerals and signs, and is not described. The matters herein not particularly described in Embodiment 5 are the same as those in Embodiments 1 to 4. In Embodiments 1 to 4, the recording medium S is conveyed so as to be stacked on the discharge tray 19, but the transport destination is not limited to this. For example, as in the present embodiment, the recording medium S may be conveyed to a finisher device 30 including a stapling mechanism, a punch processing mechanism, and the like as a post processing device for performing prescribed post processing on the recording medium having an image recorded thereon. At this step, to the finisher device 30, the recording medium S is conveyed through either of the main conveying path 20 and the sub conveying path 21. Whereas, to the discharge tray 19, the recording medium S is conveyed through either of the second sub conveying path 24, and the third sub conveying path 25 further branching off from the second sub conveying path 24. With this configuration, it becomes possible to provide a plurality of discharge destinations.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-100395, filed on Jun. 9, 2020, which is hereby incorporated by reference herein in its entirety.

What is claimed is:

1. An image recording apparatus comprising:

a stacking portion on which a recording medium is stacked;

a recording portion for recording an image on the recording medium;

a heating portion for heating the recording medium recorded by the recording portion;

a discharge portion for discharging the recording medium recorded by the recording portion;

a first path for conveying the recording medium in order of the stacking portion, the recording portion, the heating portion, and the discharge portion;

a second path branching off from the first path at a first branch part between the recording portion and the heating portion, and for discharging the recording medium to the discharge portion without passing through the heating portion; and a third path branching off from the first path at a second branch part between the recording portion and the first branch part, and for conveying the recording medium, the recording surface of which is inverted, toward a location between the stacking portion and the recording portion in the first path.

2. The image recording apparatus according to claim 1, wherein the recording medium, the conveying direction of which is reversed, is guided to the third path at the second branch part.

3. The image recording apparatus according to claim 2, wherein the recording medium to be guided to the third path includes a recording medium, the conveying direction of which is reversed after passing through the heating portion, and a recording medium, the conveying direction of which is reversed after being guided to the second path.

4. The image recording apparatus according to claim 2, further comprising a conveying roller included in the second path and capable of reversible rotation, and wherein the conveying direction of the recording medium is reversed by counter rotation of the conveying roller.

5. The image recording apparatus according to claim 1, wherein the first branch part and the second branch part are each provided with switching means for switching between conveying paths for the recording medium.

6. The image recording apparatus according to claim 1, wherein the second path conveys the recording medium guided from the first branch part to a location between the heating portion and the discharge portion of the first path.

7. The image recording apparatus according to claim 1, wherein the second path conveys the recording medium guided from the first branch part to a second discharge portion different from the discharge portion.

8. The image recording apparatus according to claim 1, further comprising a discharge tray on which the recording medium discharged by the discharge portion is stacked.

9. The image recording apparatus according to claim 1, further comprising a post processing apparatus for performing prescribed post processing on the recording medium discharged by the discharge portion.

10. The image recording apparatus according to claim 1, wherein a length of a conveying path from the first branch part to the discharge portion through the first path is not greater than a length of a conveying path from the first branch part to the discharge portion through the second path.

11. The image recording apparatus according to claim 1, wherein the heating portion is not actuated in a case where the recording medium is conveyed along a conveying path not passing through the heating portion, and is discharged.

12. The image recording apparatus according to claim 1, further comprising a fourth path branching off from the second path at a third branch part between the first branch part and the discharge portion, and for discharging the recording medium.

13. The image recording apparatus according to claim 12, further comprising a second heating portion arranged in the fourth path, and for heating the recording medium passing through the fourth path.

14. The image recording apparatus according to claim 13, wherein a control condition of the second heating portion is different from a control condition of the heating portion arranged in the first path.

15. The image recording apparatus according to claim 13, wherein a heating system of the second heating portion is different from a heating system of the heating portion arranged in the first path, and wherein the heating systems include at least a contact heating system for bringing a heating member into contact with the recording medium, and a warm air system for blowing warm air to the recording medium.

16. The image recording apparatus according to claim 1, further comprising:

an image reading portion for reading an image of a document sheet, wherein the recording portion is capable of recording the image, which has been read by the image reading portion, on the recording medium.

* * * * *